United States Patent [19]

Taylor

[11] Patent Number: 4,740,044

[45] Date of Patent: Apr. 26, 1988

[54] DESK ORGANIZER UNIT

[76] Inventor: Paul B. Taylor, 104 Tulsa Dr., Rogers, Ark. 72756

[21] Appl. No.: 883,977

[22] Filed: Jul. 10, 1986

[51] Int. Cl.[4] ..... A47B 51/00

[52] U.S. Cl. ..... 312/270; 312/310; 312/322

[58] Field of Search ..... 312/270, 291, 196, 272, 312/272.5, 310, 223, 298, 309, 322, 323

[56] References Cited

U.S. PATENT DOCUMENTS

| | | | |
|---|---|---|---|
| 145,378 | 12/1873 | Wilkins | 312/310 |
| 258,814 | 5/1882 | Scott | 312/310 |
| 294,388 | 1/1885 | Hull . | |
| 498,175 | 5/1893 | Lawson . | |
| 654,922 | 7/1900 | Schipkowski . | |
| 947,359 | 3/1908 | Toso . | |
| 1,231,860 | 7/1917 | Deevers . | |
| 1,599,603 | 9/1926 | Westlake . | |
| 1,978,819 | 10/1934 | Roller | 312/223 |
| 1,996,767 | 4/1935 | Hunter | 312/223 |
| 2,010,476 | 8/1935 | Boylan . | |
| 2,658,985 | 11/1953 | Maxwell . | |
| 2,785,036 | 3/1957 | Elsden-King et al. | 312/327 |
| 4,088,380 | 5/1978 | Watts | 312/306 |

*Primary Examiner*—Joseph Falk
*Assistant Examiner*—Gerald N. Anderson
*Attorney, Agent, or Firm*—Peter D. Keefe

[57] ABSTRACT

A vertically movable desk organizer unit, mounted at the front end of a desk, having pivotable trays and bins. A compartmentalized storage center which may be raised and lowered is provided, having rotatable, coverable trays, tiltable bins, and other receptacles for office stationary. When the organizer is in the raised position, the trays and bins pivot towards the desk surface, permitting easy access; when the unit is being lowered to a position flush with the desk surface, the trays and bins are vertically pivoted, thereby ensuing a minimum of depth requirement for the unit beyond the end of the desk.

1 Claim, 6 Drawing Sheets

DESK ORGANIZER UNIT

BACKGROUND OF THE INVENTION

This invention relates to vertically movable desk organization devices, more particularly to desk organizers containing compartmentalized storage facilities.

The concept of employing an auxiliary organizer unit in conjunction with a standard desk has long been considered in the prior art. U.S. Pat. No. 2,010,476 to Boylan is typical of these, wherein a vertically movable cabinet, having a series of filing trays, is disposed at the front end of a desk. The user raises the cabinet when wishing to store or access papers, supplies, etc., and lowers the cabinet when wishing to increase usable desk surface area and reduce clutter.

All these schemes have for their central purpose a means to store papers and office supplies in a neat and organized fashion with the added capability of vertical retraction of the entire organizer to a point flush with the desk surface. However, none of these devices have solved the long standing need in the art to provide a vertically retractable stationary organizer which has a tray arrangement permitting a fully functional access to papers, pads, pens, and other supplies, when in the raised position, while at the same time providing easy retractability of the entire unit. Nor have any of the organizers thus far devised addressed the need to minimize structural complexity and weight, as well as minimization of depth beyond the end of the desk.

It is an object, therefore, of the present invention to provide a vertically retractable desk organizer for documents and office stationary having a lightweight construction and an easily operated and uncomplicated raising and lowering mechanism.

It is a further object of the invention to provide a desk organizer having vertical storage of papers and supplies, with easy, horizontal access to the stored items through the use of pivotable storage trays with lids, pivotable pads and tiltable storage bins.

It is yet a further object of the invention to provide a desk organizer that is narrow in design and can be fitted either to an existing standard desk or made an integral component of a new desk.

It is still a further object of the invention to provide a vertically retractable desk organizer that improves the efficiency and neatness of the work area when in the raised position, and security for valuable documents and supplies and unimpaired and augmented desk top area when in the lowered position.

These, and additional objects, advantages, features and benefits of the invention will become apparent from the following specification.

SUMMARY OF THE INVENTION

In the present invention, a vertically movable desk organizing device for office supplies and documents is provided, having pivotable storage units facilitating easy access and minimal depth requirement.

The invention generally comprises a cabinet of rectangular shape, the length of which being the same as the width of the desk to which it is intended to mate, and a lifting mechanism, which together constitute the desk organizer. At either end, the cabinet has pivotable trays adapted for the storage of standard stationary paper, each of the trays being covered by a separately pivotable lid. The area between the trays, the middle of the cabinet, has, in the center section, provision for pivotable pads, clips for flat and round objects, and a recessed light. Symmetrically disposed on either side of the center section, but still in the middle of the cabinet between the paper trays, is an area having tiltable bins for the storage of small stationary items, such as paper clips. The cabinet is therefore composed of three parts: the two trays at either end and the middle area. These are joined by a unit mounting bracket underneath. The mounting bracket, in turn, is movably connected at each end to channels that are fastened to a front panel which, in turn, is fixedly attached to the front of the desk, its purpose being to cooperatively engage locking and catch mechanisms on the cabinet.

A unit enclosure back panel may be provided to act as a veneer covering for the desk organizer unit, giving the desk a natural appearance from the front.

In operation, the user would lift a fully retracted desk organizer cabinet utilizing lift handles provided at the top, after unlocking it. When the organizer reaches its maximum extension, a spring loaded catch at the center of the cabinet, would engage a slot in the unit enclosure front panel, thereby fixedly positioning the cabinet. The trays, which are vertically oriented, may now be pivoted to a horizontal orientation, and the lids covering them may be raised to the vertical, if desired. The bins and pad holders may also be pivoted to make access to them, during a work session at the desk, more easily accomplished. To lower the unit, the user would first close the lids on the trays, pivot the trays to the vertical, vertically pivot the pads and bins, then press a spring loaded catch release button, and gently lower the cabinet until its top is flush with the desk surface. In the fully retracted position, a locking catch engages, securing the organizer from unauthorized access.

DETAILED DESCRIPTION OF THE PREFERRED EMBODIMENT

Figure 1:
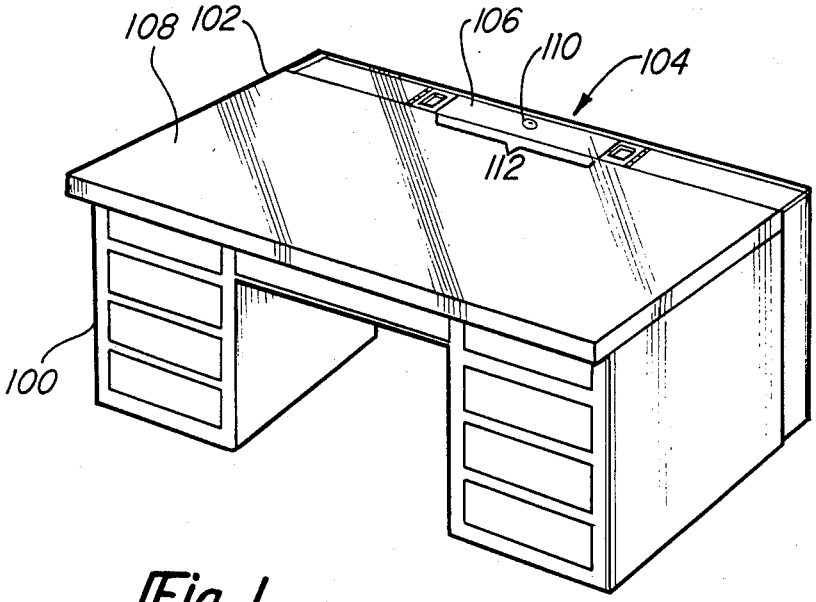
FIG. 1 is a perspective view of a standard desk with the invention attached, in the fully retracted position, seen from the rear where the user would be seated.

A. Plan of the Invention:

Refering now to the figures, FIG. 1 shows generally a standard type desk 100 with the present invention attached at its front end 102. The organizer cabinet 104 is shown in the fully retracted position, so that the top surface 106 is positioned flush with the desk surface 108, with easy access to a key operated lock 110 and lift handles 112.

Figure 2:
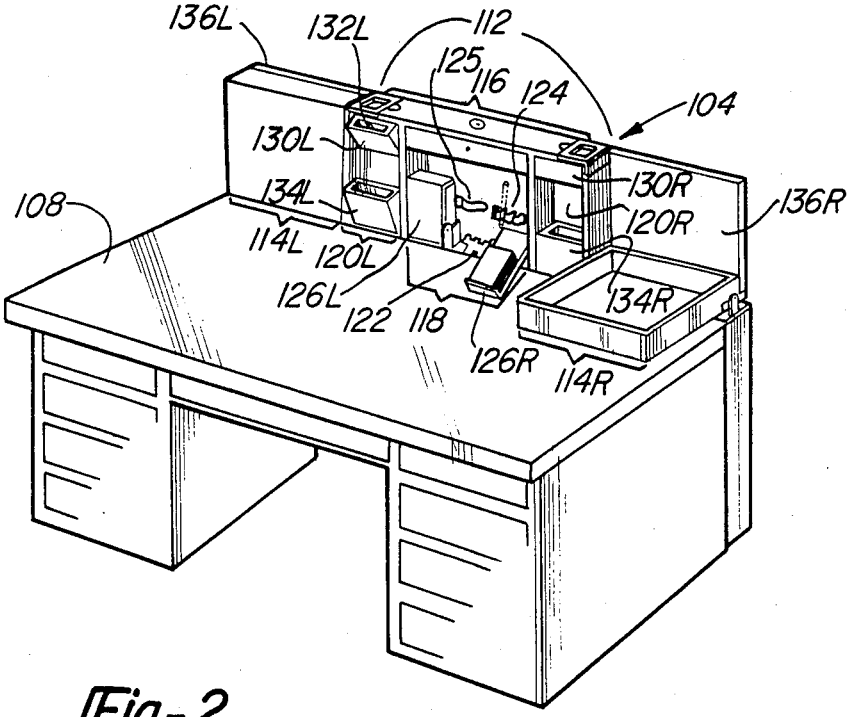
FIG. 2 is a perspective view as in FIG. 1, wherein the cabinet is shown in the fully raised position.

FIG. 2 shows the organizer cabinet 104 in the raised position. The cabinet is composed of three sections: two standard bond paper trays 114L and 114R located at either end, and a central office supplies storage area 116. The central area is comprised of a middle section 118 and on either side thereof bins 120L and 120R. The middle section 118 is comprised of a base holder for elongated objects 122, a clip holder for round objects 124 and a clip holder for flat objects 125, pivotable pad holders, 126L, shown in the vertical orientation, and 126R, shown pivoted outward, and a light 128 located just under the top, particularly shown in FIG. 4. On either side of the middle section are located bins 120R and 120L for the storage of loose stationary items. Both sets of bins have identical construction: an upper bin 130R and 130L, which serves to store smaller items, having a partition 132L and 132R, and a lower bin 134R and 134L, which is somewhat larger than the upper bin in terms of depth and is intended for the storage of larger sized or higher quantity items. Both the upper and lower bins are designed to tilt outward toward the seated desk user; they are shown in the figure in a vertical orientation on the right and tilted orientation on the left. On either side of central storage area 116, are located paper trays 114L and 114R which are dimensioned to receive standard sized stationary paper. Each of the trays is pivotably mounted to the cabinet so that they may be rotated to a horizontal orientation from the vertical orientation; further, each is provided with a lid covering 136L and 136R, which is independently pivotable in relation to its respective tray. It will be seen from the figure, that the tray lids are positioned directly away from the seated desk user when the trays are in the vertical orientation. Rotation of the trays to the horizontal orientation is, therefore, necessary to access their contents. This also applies to the pads, upper bins, and to a lesser degree, the lower bins. In the Figure, tray 114L and its lid 136L are shown vertically oriented, tray 114R is shown horizontally oriented with its lid 136R raised to the vertical orientation. It will be seen from FIG. 2 that the user of the desk will have an extremely easy access to the trays, pads and bins because they have been pivoted; an examination of FIGS. 1 and 2 will show that retraction of the desk organizer to a vertical location which is flush with the desk surface requires only a minimal amount of attachment room beyond the front end of the desk because the trays, pads and bins can pivot back to the vertical orientation.

Figure 3:
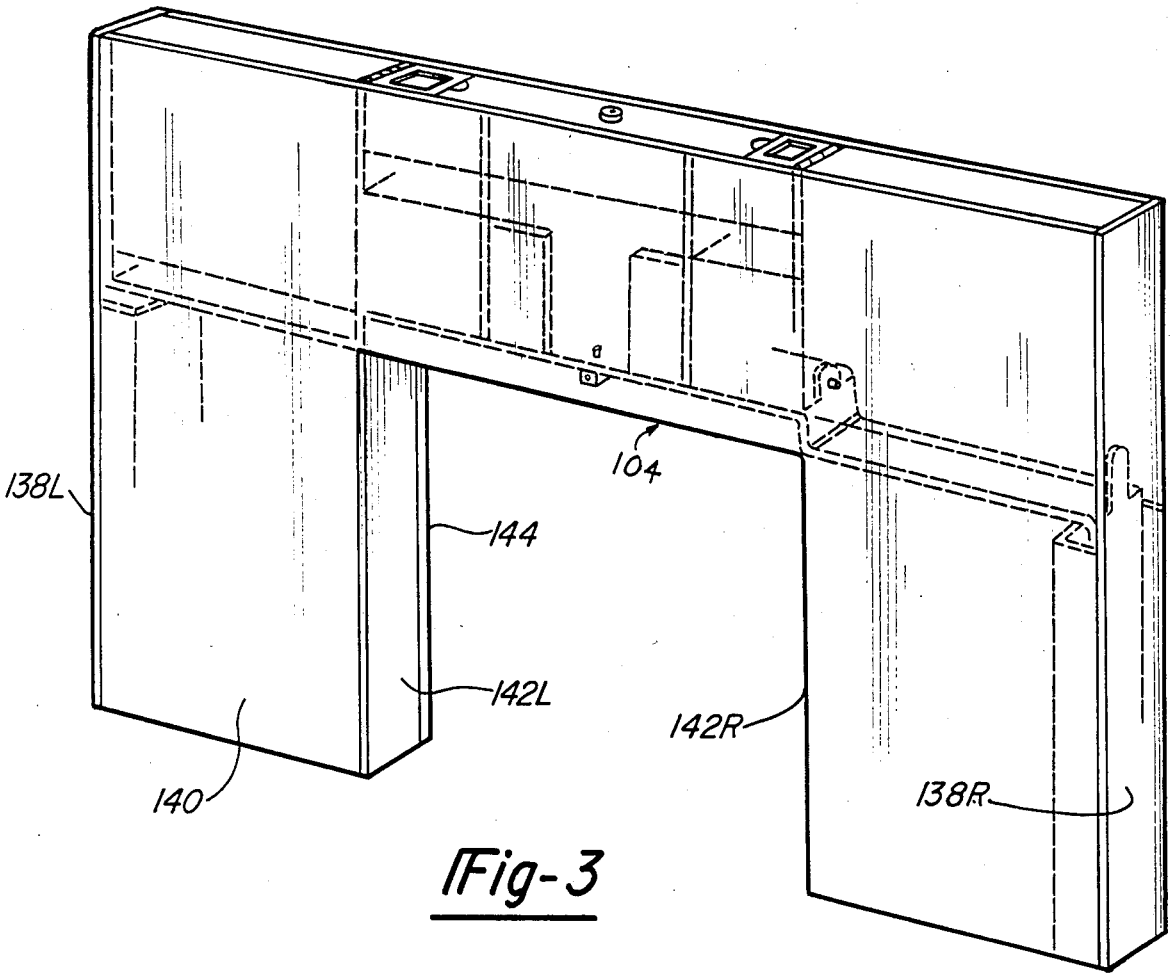
FIG. 3 is a perspective view of the invention standing alone, showing internal components in outline, seen from the side facing the desk.

FIG. 3 shows the exterior of the invention standing alone. The cabinet 104 is attached to the desk movably through the use of a mounting bracket which cooperatively engages channels at either end of the desk organizer, as will be detailed in Part B. These are fixedly attached to the front of the desk through means of screws or bolts inserted through apertures in an attached front panel 140. Side panels 142L and 142R and back panel 144, which is substantially of the same dimension as front panel 140, form cosmetic coverings, enhancing the attractiveness of the desk organizer in open office settings. The unit enclosure front panel 140, which fixedly attaches to the desk, connects to and reinforces the end panels 138L and 138R and serves to work cooperatively with the catch mechanisms, as discussed in Part B.

Figure 4:
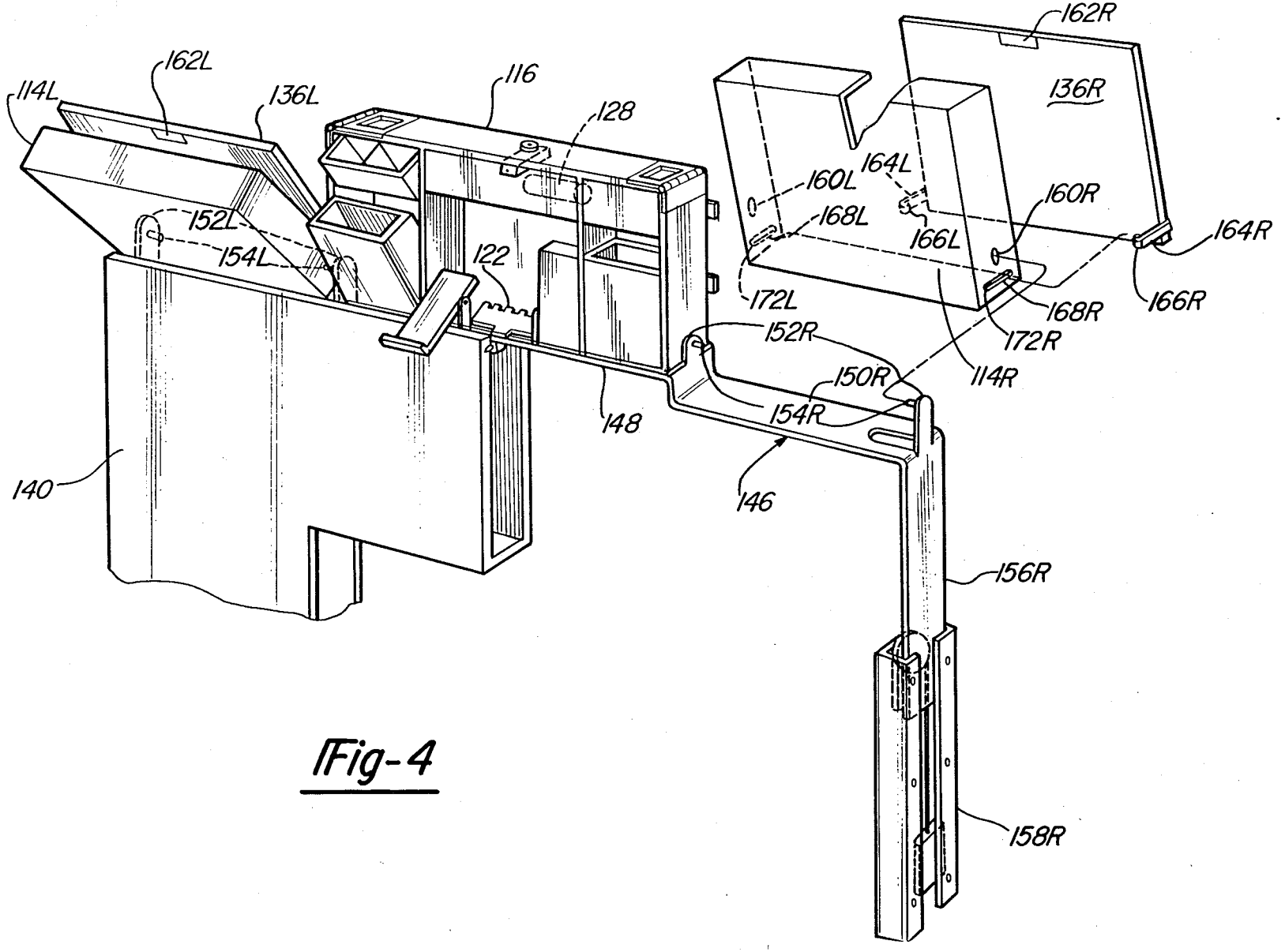
FIG. 4 is a perspective view of the invention from the side facing the desk, showing generally the integral components of the invention.
Figure 5:
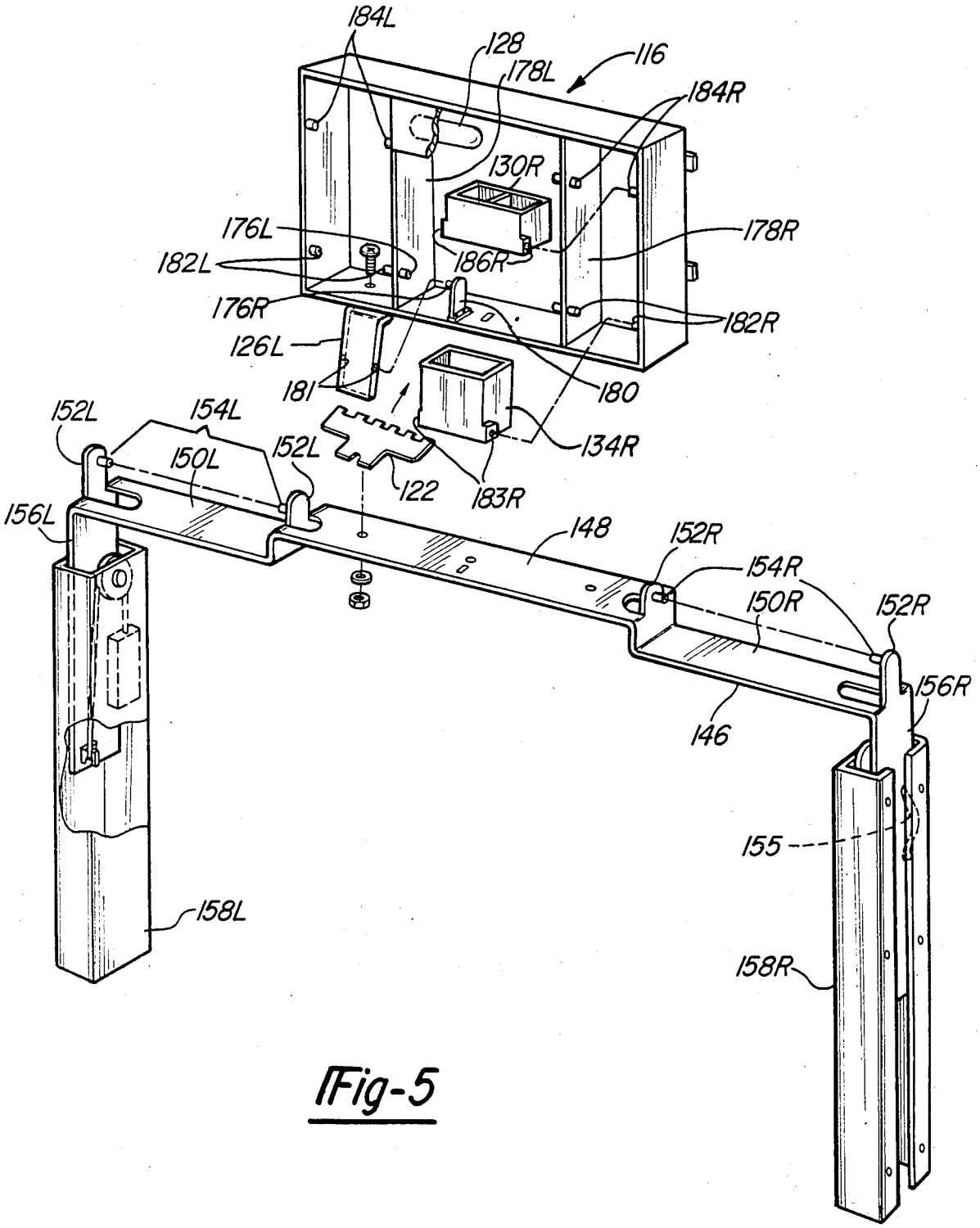
FIG. 5 is a perspective view of the invention from the side facing the desk, showing the lift mechanism and middle section.

B. Mechanical Structure of the Invention:

The three sections of the cabinet 116, 114L and 114R are connected together to form the cabinet 104 via a mounting bracket 146, shown in FIGS. 4 and 5. The mounting bracket is shaped in an upside down "U" fashion, where the vertically disposed sides 156L and 156R are designed to fit cooperatively into a channel 158L and 158R, respectively. The channel serves to aid guidance of the vertical movement of the cabinet via cooperative engagement with the vertically disposed sides of the mounting bracket, as will be more fully detailed following. It will be seen from FIGS. 4 and 5 that the bracket has three regions of varying height, each being designed to cooperate with a section of the cabinet, as follows: The bottom of the central storage area 116 is fixedly attached to the center section 148 of the mounting bracket, via the use of screws or other fastening devices, holes in the mounting bracket being provided for this purpose. On either side of the center section of the mounting bracket 146 are the bracket provisions 150L and 150R for the trays. However, because the trays are pivotable, they do not fixedly attach to the bracket. Provision for pivotable attachment of the trays is accomplished through the use of tray pivot hinges 152L and 152R formed from the bracket 146 and at a ninety degree disposition thereto, having pins 154L and 154R adapted to cooperatively engage elongated slots 160R and 160L (shown particularly for tray 114R and is similarly applicable to tray 114L, though not shown) in the sides of the trays, as will be discussed in greater detail following.

Figure 6:
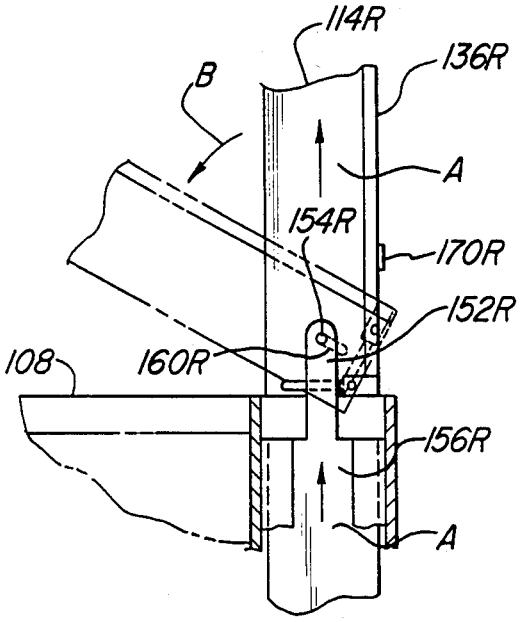
FIG. 6 is a side view of the invention showing in detail the tray pivotal means with the tray in the vertical orientation.

FIG. 6 is a side view of the cabinet after it has been raised above the desk surface along the direction of arrow A, where the right tray 114R is seen in vertical orientation. Remarks that follow apply equally, in mirror image fashion, to the left paper tray 114L. The tray pivot hinge 152R consists of a pair of projections in the mounting bracket 146 which extend upward above the desk surface 108. These pivotably attach the tray 114R to the mounting bracket 146 via a pin projection 154R extending 90 degrees from each hinge projection, which are adapted for insertion into the elongated slots 160R and 160L (shown in FIG. 4) located, respectively, on each side of the tray. Rotation of the tray is accomplished in the direction of arrow B. Rotation occurs about the top inside surface of the elongated slots. It will be seen that the need for varying heights in the mounting bracket is due to the need to accommodate rotation of the tray, as shown in FIG. 4.

Figure 14:
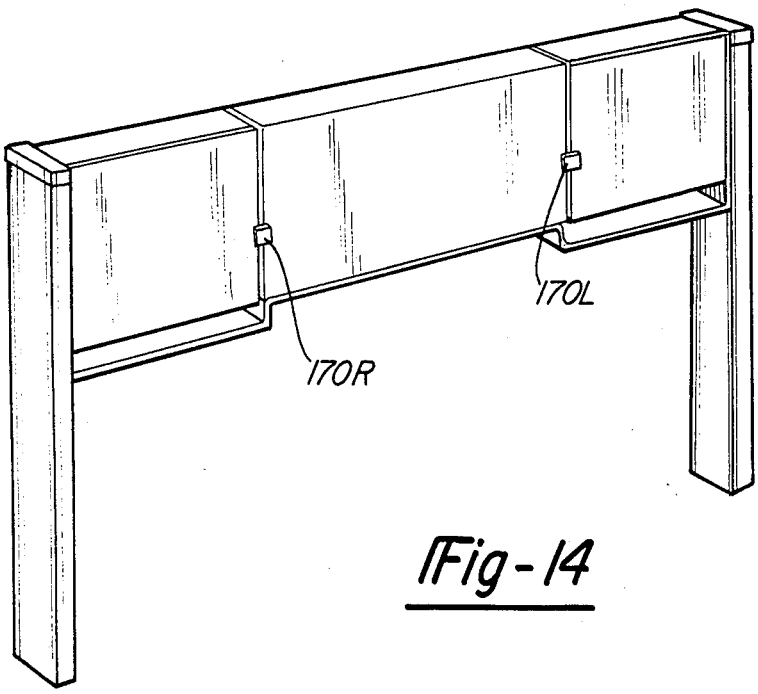
FIG. 14 is a perspective view of the invention seen from the side away from the desk.
Figure 7:
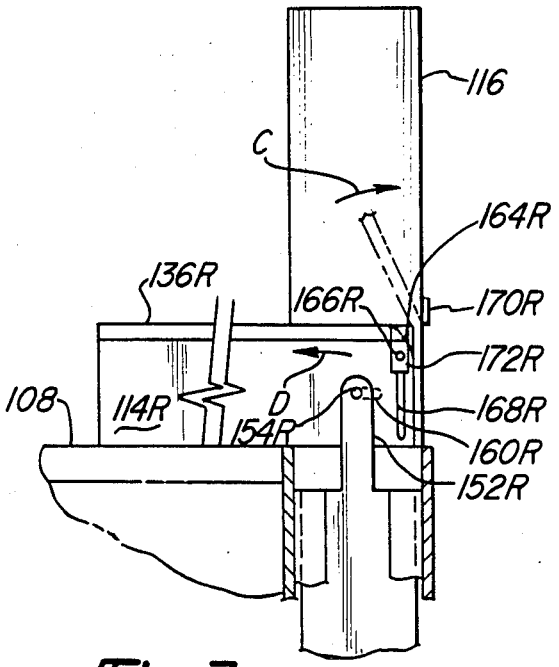
FIG. 7 is a side view as in FIG. 6 where the tray is in the horizontal orientation.
Figure 8:
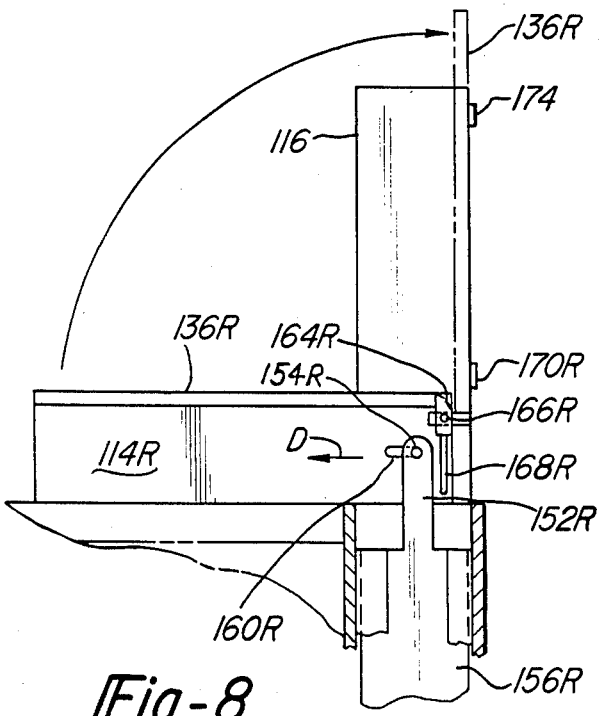
FIG. 8 is a side view as in FIG. 6 where the tray lid has pivoted to the vertical orientation.
Figure 9:
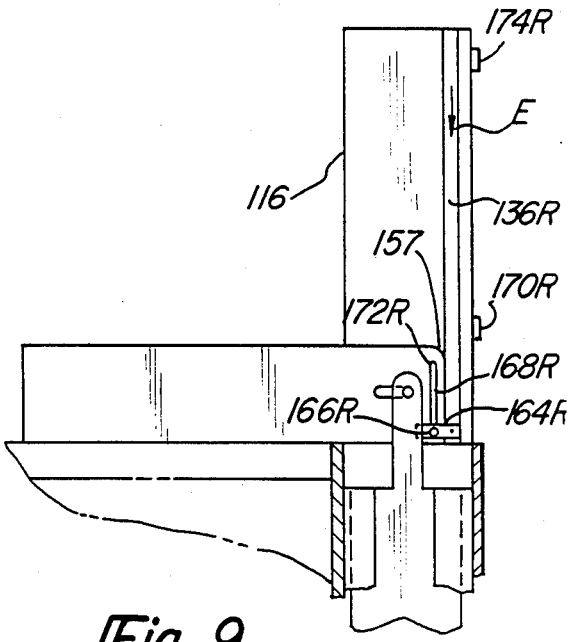
FIG. 9 is a side view as in FIG. 6 where the lid has been lowered into final vertical position.

The result of rotation of the tray to the horizontal orientation is shown in FIG. 7. In order to access the contents of the tray, it is necessary to manually lift the tray lid 136R. The lid is held against the tray 114R by means of a magnetic catch 162R, as shown in FIG. 4, which is easily overcome by simple hand pressure. The tray is lifted by rotation about a lid hinge pivot in the direction of arrow C. The lid hinge consists of a pair of brackets 164R and 164L, as shown in FIG. 4, which are located on either side of the lid and disposed at an angle of 90 degrees from the plane defined by the lid surface. Projecting perpendicularly towards the tray from each of the lid brackets 164R and 164L are pins 166R and 166L, as shown in FIG. 4. A lid hinge slot on each side of the tray 168R and 168L, as shown in FIG. 4, substantially the length of the depth of the tray, is provided to cooperatively engage the lid hinge pins. As the lid 136R is raised in the direction of arrow C, it will come in contact with a backplate 170R, shown particularly in FIG. 14, which will cause the tray 114R to move forward along the surface of the desk, indicated by arrow D. This tray motion causes relative movement between the tray and the hinge pin 154R, which is accommodated by the elongation in the slot 160R. The rear of the tray is rounded 157 in order to allow equal distance between the lid pivot hinge and the lid tray slot at all points during rotation, as shown in FIG. 9. When the lid is in the fully vertical orientation, the tray will have moved along the desk surface a distance such that the hinge pin 154R will now be in contact with the other end of the elongated slot 160R, as shown in FIG. 8. During lid rotation, the lid hinge pins remain in substantial contact with the upper end 172R and 172L, as shown in FIG. 4, of the lid hinge slots.

The result of rotation of the lid is shown in FIG. 8. It will be seen that the lid is in contact with the backplate and that the lid has moved along the desk in the direction of arrow D. When the lid is in the fully vertical orientation, the lid is gently lowered in the direction of arrow E. The reason for this is essentially aesthetic: the lid when raised to the vertical is somewhat higher than the top 106 of the middle section 116 of the desk organizer, and the elongation in the lid hinge slots 168R and 168L accommodate lowering of the lid to the same height as the desk organizer middle section, yielding an attractive look to the unit.

The result of lowering the lid is shown in FIG. 9. It will be seen that when the lid is at the same height above the desk surface 106 as the desk organizer middle section 116, the lid hinge pin has reached the lower end of the lid slot on each side of the tray. A magnetic catch 174R holds the lid in the vertical orientation.

To close the lid and then raise the tray to the vertical orientation the procedure just described is sequentially reversed.

Figure 12:
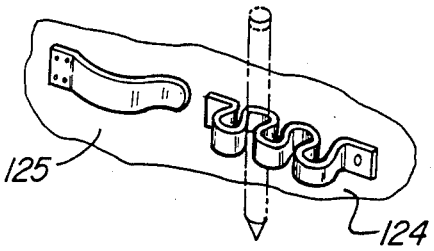
FIG. 12 is a perspective view of the clip means.

In the central area of the cabinet 116, provision is made for the storage of elongated objects in the form of a base holder 122 having a plurality of slots, as shown in FIGS. 1, 4 and 5. Also, provision is made for the storage or round objects using clips 124, as well as flat objects using a spring clip 125, both are shown in detail in FIG. 12, and are located in the middle section of the desk organizer, generally shown in FIG. 2.

The pads 126R and 126L are made pivotable through the use of a pair of pad pivot hinges having generally the same structural configuration as the tray pivot hinges, as shown in FIG. 5. In the case of the left pad 126L, which applies in mirror image fashion to the right pad, pins 176R and 176L, the former attached to the inner wall 178L of the cabinet and the latter attached to a bracket 180, insert into an aperture 181 on each side of the pad holder.

The lower bins 134L and 134R are made pivotable through the use of pins 182R and 182L, respectively, and shown particularly for bin 134R in FIG. 5, in similar manner to that utilized for the pads, in which the pins insert into apertures 183R, as shown for bin 134R. The upper bins 130L and 130R are pivotably attached to the cabinet in similar manner, through pins 184R and 184L, and cooperating apertures, as shown particularly for bin 130R, in which apertures 186R cooperatively engage the pins in FIG. 5.

Figure 11:
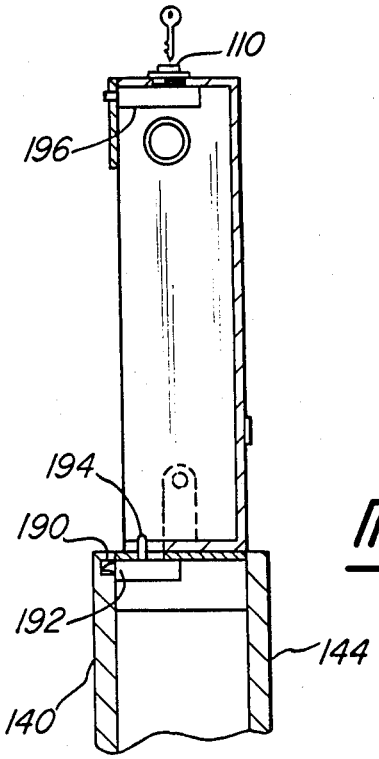
FIG. 11 is a side view showing the locking catch means.

The structure associated with raising and lowering the cabinet may be seen in FIG. 5 and functions as follows: The channels 158L and 158R, which are fixedly attached to the desk via connection to the front panel, guide the vertical movement of the cabinet through close tolerant relation to the vertically disposed sides of the mounting bracket 156R and 156L via the use of springs 155, (one of which being shown). There is provided a sufficient number of springs so as to give frictional resistance and guidance support for the cabinet in relation to the channel. A notch 190 in the front panel 140 accepts a spring loaded catch 192 which is attached at the lower end of the cabinet, beneath the mounting bracket 146, as shown in FIG. 11. A spring release 194 located at the center of the cabinet, located in the front of the base holder 122, allows for manual release of the catch and subsequent retraction of the cabinet. A lock 110, with integral catch mechanism 196, located at the top 106 of the middle section 116 of the cabinet secures the unit via the notch 190, when the cabinet is in the fully retracted position. The cabinet may be raised, upon release of the lock, by lifting the unit via use of retractable lift handles 112 located in the top of the cabinet. These set into recesses on the cabinet top, shown in detail in FIG. 3.

Figure 10:
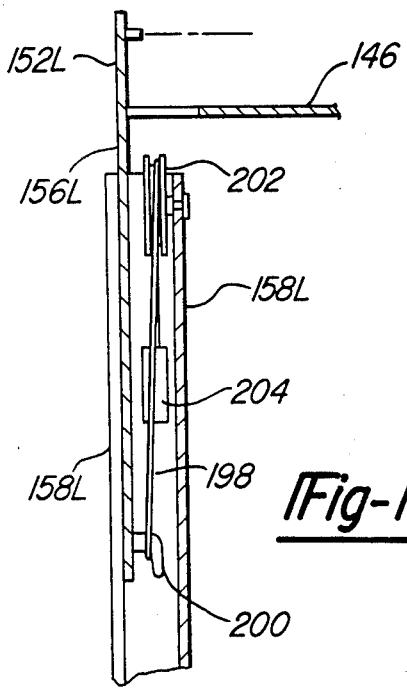
FIG. 10 is a side view of the gravity counterbalance means.

The cabinet is generally light enough that no assistance is required to help the user to raise the cabinet to the fully raised position. However, many lift assist schemes are in the relevant art, for instance U.S. Pat. Nos. 294,388; 498,175; 654,922; 947,359; 1,231,860; 1,599,603; 2,010,476; and 2,658,985, each of which is hereby incorporated by reference. FIG. 10 shows the preferred assist means, whereby a counterweight is utilized to neutralize the weight of the cabinet and its customary contents. A cord 198 is attached at one end to a hook 200, which itself is connected to the vertically disposed side of the mounting bracket 156L, then extends over a pulley 202, which is attached to the channel 158L, and finally terminates at the other end with a counterweight 204. While the Figure shows the configuration for the left side of the desk organizer, preferrably an identical structure is placed on the right side in combination with that on the left.

Figure 13:
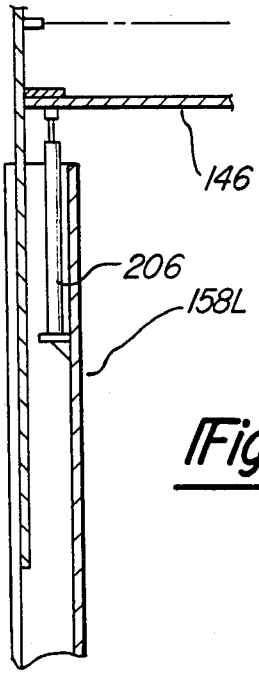
FIG. 13 is a side view of an alternative lift means utilizing fluidic pressure.

FIG. 13 shows an alternative lift mechanism utilizing a fluidic pressure piston-cylinder apparatus of the type in common commercial use, where the piston unit 206 is connected between the mounting bracket 146 and the channel 158L, preferrably one being on each side of the organizer. It would react responsively when the lock latch 196 is released.

C. Operation:

With the desk organizer cabinet in the fully retracted position, the user inserts a key into the lock at the top of the cabinet and turns it. This releases the lock latch. The user now grabs the lifting handles and elevates the cabinet until the spring biased latch at the cabinet bottom clicks into place in the slot provided on the front panel. The bins, pads and trays may now be rotated outward from the vertical orientation by simply taking hold and gently rotating them. The lids may be rotated to the vertical orientation, if access to the trays is desired; for cosmetic reasons, the user may wish to keep them coverd.

To retract the cabinet, the user first raises all the trays, bins and pads to the vertical orientation, then presses the catch release at the lower center of the cabinet, and then pushes the cabinet downward from the top until it is fully retracted, and the top of the cabinet is flush with the desk top and the key operated lock has latched.

D. Conclusion:

The cabinet may be made of a material compatible with the office decor in which it will be used: wood, metal or plastic. It is preferred that the mounting bracket and channels be made of metal.

To those skilled in the art to which this invention apertains, the above described preferred embodiment may be subject to change or modification. Such changes or modifications can be carried out without departing from the scope of the invention, which is intended to be limited only by the scope of the appended claims.

What is claimed is:

1. A desk organizer, comprising:

a cabinet having a top;

a central storage area located centrally in said cabinet, said central storage area having attached thereto a plurality of spring clips, a light and an apertured base plate, said central storage area further having on either side thereof pad holders pivotably attached thereto;

two sets of bins, each said set of bins having an upper and a lower bin, each of said upper and a lower bins being pivotably attached to said cabinet, one said set of bins being located on each side of said central storage area;

two trays, each said tray being pivotably attached to said cabinet, one said tray being located at each end of said cabinet in adjacent relation to a respective said set of bins at said end of said cabinet;

two lids, one lid for each said tray, each said lid being pivotably attached to one of said trays;

a mounting bracket attached to said cabinet, said mounting bracket having a first projection member and a second projection member, one of said first and second projection members being located at each end of said mounting bracket;

two channels, said first projection member being reciprocably mounted in one of said channels and said second projection member being reciprocably mounted in the other of said channels, said first and second projection members being reciprocable along said channels;

a front panel fixedly attached to said channels, said front panel having attachment means for attaching said desk organizer to a desk, said front panel further having a slot;

a first spring loaded catch attached to said cabinet, said first spring loaded catch being located substantially adjacent said base plate, said first spring loaded catch cooperatively engaging said slot in said front panel when said cabinet is in a raised position; and a second spring loaded catch, said second spring load catch being lock operated, said second spring loaded catch being located substantially at said top of said cabinet and in vertical alignment with said first spring loaded catch, said second spring loaded catch cooperatively engaging said slot in said front panel when said cabinet is in a lowered position.

* * * * *